United States Patent [19]

Wloszczyna

[11] Patent Number: 4,502,605

[45] Date of Patent: Mar. 5, 1985

[54] CONTAINER CLOSURE INTEGRITY SYSTEM

[75] Inventor: Donald R. Wloszczyna, West Islip, N.Y.

[73] Assignee: Denerik Creativity, Inc., West Islip, N.Y.

[21] Appl. No.: 626,180

[22] Filed: Jun. 29, 1984

[51] Int. Cl.[3] ..... B65D 55/02

[52] U.S. Cl. ..... 215/230; 215/203

[58] Field of Search ..... 215/230, 203, 365; 206/364, 365, 459

[56] References Cited

U.S. PATENT DOCUMENTS

| | | | |
|---|---|---|---|
| 2,537,124 | 1/1947 | Earle et al. | 154/140 |
| 2,567,445 | 9/1951 | Parker | 23/230 |
| 2,787,238 | 4/1957 | Luce | 23/253 TP |
| 3,011,874 | 1/1960 | Deutsch | 23/253 TP |
| 3,093,242 | 6/1963 | Hyuck et al. | 206/364 X |
| 3,221,428 | 12/1965 | Fischler et al. | 40/22 |
| 3,312,368 | 4/1967 | Reynolds et al. | 220/53 |
| 3,515,852 | 6/1970 | Janssen et al. | 117/122 |
| 3,738,811 | 6/1973 | Cheng | 23/232 R |
| 3,826,221 | 7/1974 | Ross | 215/230 X |
| 3,862,824 | 1/1975 | Chapman | 23/253 TP |
| 3,899,295 | 8/1975 | Halpern | 206/459 X |
| 3,923,198 | 12/1975 | Brochman | 23/253 TP |
| 4,071,157 | 1/1978 | Apellaniz | 215/252 |
| 4,098,577 | 7/1978 | Halpern | 206/364 X |
| 4,187,798 | 2/1980 | Yoshimura | 116/206 |
| 4,261,478 | 4/1981 | Summers | 220/270 |
| 4,328,182 | 5/1982 | Blake | 422/56 |
| 4,349,509 | 9/1982 | Yoshikawa et al. | 422/57 |
| 4,429,803 | 2/1984 | Butterfield | 215/230 X |
| 4,432,462 | 2/1984 | Newkirk | 215/230 X |

*Primary Examiner*—Steven M. Pollard

*Attorney, Agent, or Firm*—David H. Semmes; Warren E. Olsen

[57] ABSTRACT

A container closure integrity indicator having a first component comprised of a sheet of absorbent material permeated with an indicator dye in solution with a volatile solvent, and a second component comprised of a sheet of absorbent material permeated with a volatile activator solution, with preferably has a pH outside of the range of 5–7. The two components initially are sealed together, between a closed container surface and a superposed transparent cap member, so that the resulting liquid phase defined by the components characterized by a color, which is a function of any change to the liquid phase pH with respect to the relative amounts of dye, volatile solvent solution, and volatile activator solution.

15 Claims, 8 Drawing Figures

CONTAINER CLOSURE INTEGRITY SYSTEM

BACKGROUND OF THE INVENTION

1. Field of the Invention

A container closure integrity system, characterized by a two-component indicator dye/activator combination, which sealingly is mounted within an otherwise conventional cap, and maintained separate from the contents of the container by a non-permeable aperture seal, which conventionally is of aluminum foil. Any opening of the cap will expose the indicator dye/activator combination to evaporate and oxidation effects, thereby physically and chemically altering the appearance of both components and their color, so that replicating the original, sealed condition virtually is impossible.

2. Brief Description of the Prior Art

The present invention is directed to the problem of tampering. A pharmaceutical container, particularly, creates an anxiety in the user, and a need visually to confirm that the container has not been opened, prior to his first use. The present invention has particular utility to the pharmaceutical and foods industry, wherein containers commonly have an aperture closed by a cap, with that aperture initially sealed by a liquid-impermeable material, (typically of aluminum foil), which is bonded to the perimeter of the aperture. The most common response to the problem of tampering has been to define a closure which is believed tamper-proof as a result of the mechanical design of the elements. Such mechanical design techniques have included enclosing the entire container inside of a can with a frangible aluminum top section; using shrink-wrapped seals about the cap and aperture of the container, a cap design which breaks into pieces and various wrapping materials that are destroyed upon removal. The present invention does not interfere with ease of initially opening a conventional cap, rather, an indicator displays a color to represent that the cap has been removed after its initial sealing, and an indicator which easily is visible to the consumer, through an access port designed into a surrounding cardboard package, for example.

Various prior art devices are known wherein a pH sensitive dye is used to illustrate presence or absence of a surrounding gaseous medium, wherein that medium represents a sealed condition of the package. For example, HALPERN, (U.S. Pat. No. 3,899,295) teaches an integrity indicator system for a gas-tight container. A pH sensitive dye is applied to an indicator located within a transparent container, with the activator being a basic, gaseous material that fills the container, and maintains the dye at a color representative of a pH above the slightly acidic pH of 5–7, for normal atmosphere. A related invention HALPERN, (U.S. Pat. No. 4,098,577), illustrates a printed material indicator having a first color in response to the pH of a normal atmosphere, and a second color in response to an acidic gaseous material, which is filled as an artificial atmosphere, within the container.

EARLE, et al., (U.S. Pat. No. 2,537,124), teaches a method for bonding surfaces, where the adhesive composition contains an indicator dye in an alkali suspension, that changes color upon exposure to atmosphere, thereby to correlate the tackiness or condition of dryness of the adhesive. The film forming adhesive composition includes an alkali which is volatile, so that the alkali will evaporate from the adhesive composition, and possibly also oxidize the indicator dye. There is a net reduction in the pH of the adhesive composition thereby rendering a color change, as the adhesive dries. A preferred indicator dye taught by EARLE is phenolphthalein, which is mixed into an adhesive which also contains ammonia as a preferred volatile alkali.

PARKER, (U.S. Pat. No. 2,567,445) teaches a form of cellophane packaging, wherein a transparent material, or a cap, has a semipermeable liner, to allow decomposition effects of the packaged material to contact an indicator dye. The permeable gas changes the color of the dye if the sealed material becomes more basic, for example, upon spoilage.

The present invention also relies upon various indicator dye/activator combinations, which per se are illustrated by the above-discussed prior art. It is well-known that phenolphthalein will exhibit a red color when exposed to an atmosphere having a pH in the vicinity of 9–12, and revert to a colorless condition as the pH environment is reduced, to below 9. The present invention represents improvement, however, in that an otherwise reversible reaction between an indicator dye and an activator structurally is prevented, through a two-component system. The components are structured so that exposure to atmosphere will not only drive off volatiles wetting both components, but also physically alter the absorbent mediums of each compound, as the indicator dye/activator liquid phase solution is being volatized by exposure to air.

BRIEF DESCRIPTION OF THE INVENTION

A container closure integrity system must not depend upon a mechanical feature which can be reconstructed, or replaced, by one tampering with the integrity of the package seal. The present invention relies upon drying and oxidative effects to both drive off the volatile products within an indicator dye/activator combination, and also alter, irreversibly, the mediums supporting each component. In the preferred embodiments, a sealed space is located between the inner surface of a surrounding capping member, (which is transluscent, or otherwise transparent, to light over at least a portion of its surface area), and a container surface which is liquid impermeable from the container interior. The present invention has particular utility for a closure system wherein an aperture has a foil seal which is impermeable to liquids, and particularly an alcohol and an aqueous solution of ammonia, for example. The present invention may be applied along with various conventional cap closure techniques, such as a shrink sealing around the cap and with various thread or snap designs. Therefore, the invention can coexist with conventional plastic closure tooling, and other techniques used for defining a seal against tampering or moisture loss from a bottle. The preferred embodiment is illustrated with respect to a childproof bottle having a system for lining up arrows, to enable pushing off of the cap with respect to the aperture, wherein a foil inner seal is provided as an initial seal of the container interior from the space defined between the inside of the cap and the outer surface of the foil.

The present invention requires a space to seal a two component set of absorbent media, wherein each absorbent media is saturated with liquid phase comprised of a volatile solution. The components preferably are sealed together in a space between the inner surface of a cap, and an external seal about an aperture of a container.

The term 'container' is used in its broadest sense, as is the term 'cap', and the present invention has utility in any combination where a closure mechanism acts to cap off a sealed aperture of a container. In the preferred embodiment of the invention, the aperture is sealed with a non-permeable material, such as aluminum foil, though sealing of the container aperture might be of a more permanent nature, such as any frangible wall section of an otherwise closed container. The present invention requires a pair of absorbent media to represent an indicator dye and an activator, so that a resulting liquid phase is maintained against evaporative effects until there is a failure of the integrity of that sealed space. The liquid phase enables any leakage of the material, (as by a pin hole opening into the sealed space), to result in a staining of the external region of the container, and any surrounding packaging from the seepage of the liquid phase. As long as the liquid phase is maintained between the two absorbent medias, the initial condition of one media can be dry, in the sense that it could be a printed indicia of indicator dye upon an absorbent cloth or paper, provided the activator solution is sufficient to be absorbed by each media. Hence, messages or visual indication of a failure can be used to alert consumers as to the integrity of that sealed space. In the event of a pin-hole leak, for example, the overall partial pressure of the ammonia will drop, but there also will be a localized blotching about the point of loss, rendering a stain on the media different than that of adjacent portions of the surface. The blotching is enhanced by use of an absorbent material, such as single-weave cotton cloth, which undergoes a wrinkling and shrinkage, as a result of rapid evaporative and oxidative effects as the sealed space is exposed to the atmosphere.

This invention, therefore, enables a commonly found enclosed space between a cap inner surface and an external seal about a container aperture to be utilized as an indicator space, and an indicator space which can visually be referenced through a transparent portion of a cap. Any surrounding packaging can have an access window, to allow inspection of the cap, without need to open the outer packaging. The present invention does not contaminate the container interior, since a form of seal is employed to maintain a separation. Furthermore, the absorbent media undergoes a physical deterioration as a result of the evaporation of volatiles, the media can be disposed of, in a dry state. The indication essentially is irreversible, since readmitting even an exact proportion of volatile solvent and volatile alkali solutions would result in an uneven rewetting of the absorbed indicator dye, since the entire media has shrunk or stretched from the rapid drying and oxidation, and in an uneven manner.

Further objects and features of the present invention will become more apparent hereafter, by considering the detailed description of the preferred embodiments, wherein reference is made to the accompanying drawings.

DESCRIPTION OF THE PREFERRED EMBODIMENT

Figure 1:
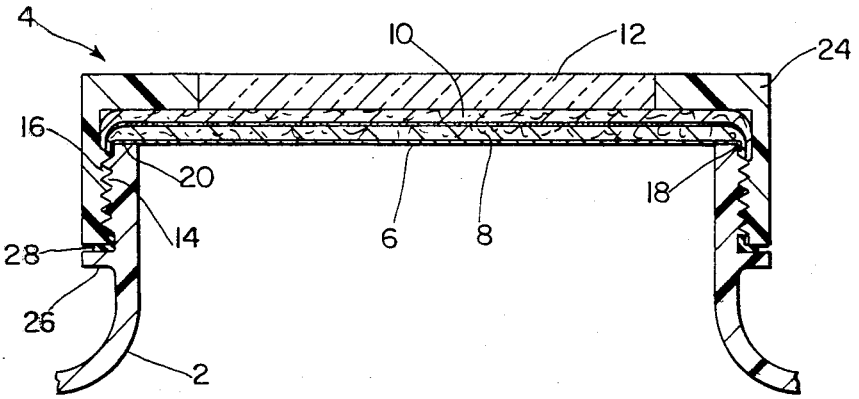
FIG. 1 is a vertical elevation view, in section, showing a preferred embodiment of the invention.

A preferred embodiment of the invention is illustrated in FIG. 1, wherein a bottle-form of a container, 2, has a conventional, superposed cap, 4, and an aperture sealed by aluminum foil, 6. The improvement comprises a two component indicator/dye activator combination, a cap either completely transparent, or at least with a translucent or otherwise transparent portion, 12, so that a first component of the indicator dye/activator combination may be mounted proximate the interior cap surface, and at least partially visible through the transparent cap portion. The first component, 10, preferably comprises an absorbent medium of a thin, single-weave cotton material, (such as light-weight cotton shirt cloth), or any other absorbent material having similar absorbency and wicking characteristics. The first component is disc-shaped and mounted proximate the interior cap surface and sealed, as shown in FIG. 1. The second component also is comprised of a disk-shaped absorbent material, such as single-weave cotton cloth, which adhesively is bound or otherwise sealed about the perimeter of the aperture, 20, and rests upon the outer surface of the liquid-impermeable seal, 6.

In the preferred embodiment, the first component, 10, functions as the carrier for the activator chemicals while the second component, 8, functions to carry a solution of the preferred indicator dye. The sealed position shown on FIG. 1 ensures intimate mixing of the liquid phase defined between the indicator dye and activator solutions; hence, it is not critical for the indicator dye to be in one component, or the other. The preferred embodiment employs a structure according to FIG. 1, with a solid annular cap portion, 24, which may have a red color, to match the exact shade of red created by the indicator chemistry chosen. A preferred indicator dye is phenolphthalein (4 grams), which has been dissolved in isopropyl alcohol (0.25 ounce). The alcohol acts to disperse the small amount of phenolphthalein evenly over the large horizontal surfaces of either absorbent media. The concentration of dye in solvent also cooperates with the alkali activator concentration (and media color) to determine the exact tint which results from combining the two components. The preferred has the first component, 10, inside the cap, wetted with ammonia as an activator, and the second component fixed about the aperture of the container and upon the outer surface of the foil seal, the color of the liquid phase sealed extends to both media. Impurities also can be added to the volatile solvent for a powdered form of indicator dye, to prolong the drying or oxidation times required upon exposure of the liquid phase defined by the two components, as cap integrity is lost. For example, salt will prolong the drying time or oxidation of the two component system, since molecules of phenolphthalein cannot combine with oxygen at the same rate of a pure solution. While the preferred embodiment contemplates a first cotton fabric wetted with an indicator dye solution and a second cotton fabric wetted with ammonia water, the indicator dye component selectively may be printed to define an indicia. The indication need not simply be a matter of color change and random blotching, rather, a controlled blotching or color change may be defined to create a visual message, through the transparent cap.

FIG. 1 shows a cap with a solid, colored annular portion, including interior threads, 16, around an axial portion, 12, which is translucent or otherwise generally transparent to allow viewing of the upper surface of the first component, 10. The round aperture is defined by a raised circumference, 20, and conventionally has a set of male threads, 14, which mate with a corresponding set of female threads, 16, defined along an axially extending annular surface of the cap. The bottle of FIG. 1 is shown with an annular flange, 26, which supports a separate moisture seal, 28, to enhance the integrity of the seal first defined between the inner surface of the cap, 4, and the outer surface of the foil seal, 6. As also shown in FIG. 1, the cloth may be pinched above the aperture circumference, 20, and against the inside of the cap, to reduce a moisture loss tendency along the path defined between the mating threads.

Figure 2:
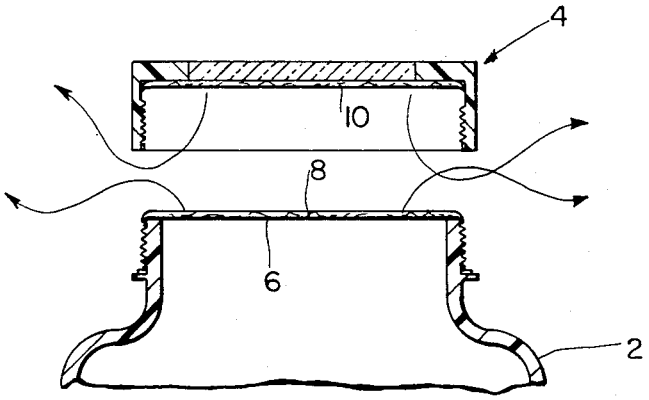
FIG. 2 is a vertical elevation view, in section, showing the cap of FIG. 1 removed from the container.

FIG. 2 illustrates, schematically, loss of volatile components from both the first component, 10, and the second component, 8, which preferably remains sealed upon the foil seal, 6. The second component, 8, initially may hold the indicator dye, (dissolved in a volatile solvent, such as isopropyl alcohol), so the volatility promotes loss of solvent, directly upwards. The first component, 10, within the inner surface of the cap, 4, initially may be wetted by ammonia water, since the vapor pressure and molecular weight of ammonia will encourage a drying of the first component, in any orientation of the cap.

Figure 3:
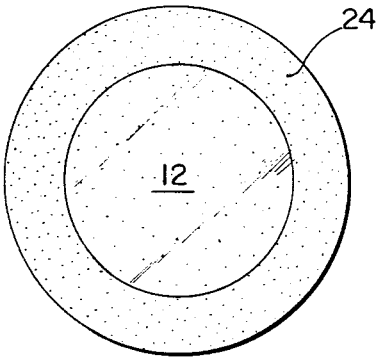
FIGS. 3 and 3A show, schematically, a top plan view of the cap in the conditions of FIG. 1 and FIG. 2, respectively.
Figure 3A:
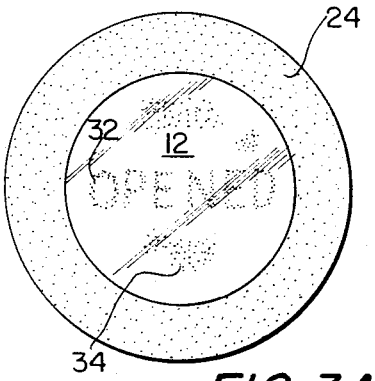

FIG. 3 illustrates, in top plan view, an annular cap zone, 24, which preferably is of a red plastic having the same initial color as that showing through the transparent window, 12. FIG. 3A corresponds to a schematic representation of the condition visible through the transparent window, 12, after the integrity of the sealed indicator space has been lost. Ammonia water has a pH of approximately 11.1, and the use of a lightweight, single-weave cotton fabric has been found the preferable media, to encourage a balance between drying time and a wicking a uniform liquid phase of the two chemical components. Material such as paper or bulk cotton have too slow a drying time, and do not exhibit the physical change in weave structure which results from the oxidation and evaporative effects that supply a secondary indication of tampering, according to the present invention.

In the preferred embodiment, one single-weave cotton fabric media is wetted by 6 drops of preferred phenolphthalein/isopropanol mixture, and the second, single-weave cotton media is wetted by 6 drops of ammonia water. Within 50 seconds of cap removal, the media went from bright red to a near colorless situation. Only such small amounts of dye solution and ammonia are required, and six drops of ammonia were found sufficient to wet a cotton fabric disc, f approximately 4 mm. diameter, so as to supply an even distribution prior to contact of the two components as the cap initially is sealed. An inherent advantage of the present invention is that each component has a media which evenly is saturated with a resulting liquid phase of indicator dye and activator, and each media will turn white, (or the color of the underlying absorbent material), after drying and oxidation is complete. Upon an open-air oxidation, or slower seepage of liquid through a pin hole, for example, there is an unpredictable oxidation and shrinking of both media which creates a blotchiness, that readily is apparent over the large surface area visible through the transparent window, 12. Additionally, staining at the point of loss likely will occur, together with a staining of any surrounding packaging.

It is preferred to use a volatile alkali solution as an activator, having a pH in the range of 9–12, in view of the wide range of available indicator dyes able to change color as the surrounding pH approaches acidity. The above-discussed HALPERN patents detailed various known combinations of indicator/dye activator combinations, usable with either basic or acid sealed environments. Since normal atmospheric air has a pH in the range of 5–7, the activator range can be a bracket on either side. Accordingly, by using a basic activator, with a pH in the range of 9–12, the condition of exposure to atmosphere not only drives off a volatile alkali, such as ammonia, but also adds a buffering effect from the slightly acidic atmosphere, to ensure a return to the normal basic condition does not occur.

Figure 4:
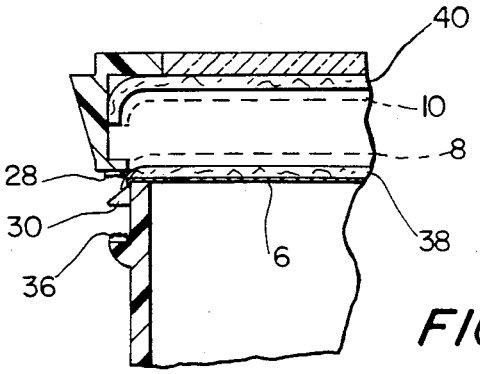
FIG. 4 is a vertical elevation view, in section, of a second embodiment of the present invention, with the cap partially removed.
Figure 5:
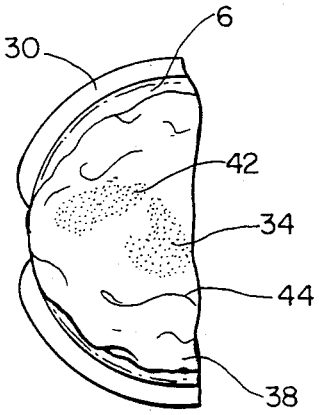
FIG. 5 is a top plan view of container aperture of FIG. 4, with the cap removed.
Figure 6:
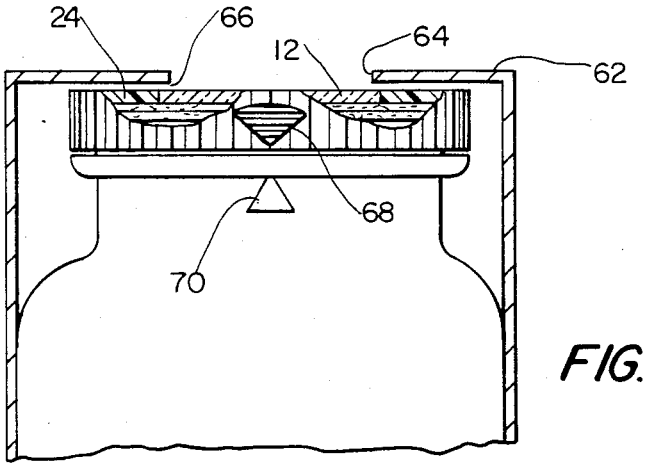
FIG. 6 is a vertical elevation view, in partial section, showing the second embodiment within a surrounding packaging.

FIG. 5 shows, schematically, a feature of the present invention in connection with a second embodiment of the invention. A physical change of the two absorbent media components results from evaporation and oxidation of the two chemical agents. FIGS. 4–6 illustrate a second embodiment with another conventional container closure, and one common to over-the-counter pharmaceuticals, such as acetaminophen capsules. The FIG. 4 container uses the same numerals for parts common to FIG. 1, such as a seal, 6, in all respects equivalent to the seal on the embodiment of FIG. 1. The aperture of the bottle is surrounded by a lock member defined as a segmented ring, 30, together with an annular frange below the ring. As the distal end of the cap is engaged over the ring, 30, it will contact the annular frange. A sealing member of adhesive may be placed between the distal end of the cap and the ridge. As shown in FIG. 4, an adhesive has been fractured into two components, 28, 36, upon a first opening. Such a frangible seal acts not only to prevent evaporation drying of liquid phase, between the outer surface of the foil seal and the inner surface of the cap, but also provides a secondary, visible indication of a previous opening.

FIG. 5 illustrates, in top plan view, a schematic representation of a blotching, 42, 34, and a wrinkling, as at 44, which results from a sudden evaporative drying of light-weight absorbent media, such as a single-weave cotton cloth, 38. The foil, 6, partially may be exposed by a shrinking of the cloth, due to random relexations of hoop stresses and other tensions from the sudden reaction with air.

FIG. 6 illustrates a vertical elevation view, in partial section, that a cap closure conventionally may include arrows, 68, 70, which are lined up to enable a push off of the cap from the ring, 30, illustrated in FIGS. 4 and 5. FIG. 6 further illustrates that a surrounding packaging, such as a cardboard box, 62, may include an access opening, 64, to allow the transparent cap portion, 12, to be visible. Note that the presence of any open space, 66, between the outer packaging and the cap of the container has no effect on the intended function of an easily monitored container integrity. A consumer simply lifts the outer packaging and looks at the top of the container, to determine whether to make a purchase.

Figure 7:
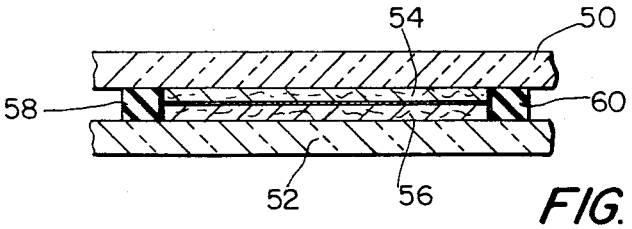
FIG. 7 is a schematic section view for a third embodiment of the present invention.

FIG. 7 illustrates, schematically, a third embodiment of the present invention in the sense that the cap, 50, is illustrated as a planar member, substantially transparent, and the aperture of the container schematically is represented as a continuous surface, 52, which functions as an impermeable seal with respect to the opposite side of the container. Also schematically shown in FIG. 7 is a first seal, 58, and a second seal, 60, which together acts to define a closed liquid phase between the first component, 54, and the second component, 56. FIG. 7 represents, in broadest terms, the applicability of the present invention to any container structure where it is possible to isolate an externally visible zone, supporting a liquid phase defined between two components, so that zone must be exposed to air upon any attempt at tampering into the body of the container.

Chemical systems usable to supply an indicator dye-/activator are well known in the art, and specific reference is made to the above-discussed patents to HALPERN, EARLE and PARKER, for candidate reagent sets known to be usable in this category of device. The preferred indicator dye is phenolphthalein, though other dyes which act with an acceptable color range change as pH goes from about 12 to below 9, include Methyl Red, Bromthyl Blue, Para-Nitrophenol, Dinitrophenol, Phenolphthalein, Meta Nitrophenol, Chlorphanol Red, Benzo Red, Meta-cresol Purple, Benzo Yellow and Brom Creson Green. By way of further example, an indicator dye solution may comprise cobalt chloride in water, with the associated indicator being comprised of ammonia water, to produce an initial green color. Other known usable, basic activators comprise Sodium Hydroxide, Potassium Hydroxide and similar organic amines having a pH in the range of 9–12. An indicator dye comprised of azurite, sodium ferrocyanide and ferric ammonium sulphate (in a powdered dye form), will create a liquid phase between the two components when an activator comprised of ammonia water is contacted with the powdered form of indicator dye. This azurite-based system will produce blue. Volatile solvents, useful to dilute the concentration of dye are well known, though isopropyl alcohol is preferred because of its high volatility, and the high solubility for dyes such as phenolphthalein. Other alcohols, such as butanol, polyols, such as glycerol, and polyethylene also are eligible vehicles to wetting a component media, and define a resulting liquid phase between the components. While the preferred technique to assure an even distribution of the indicator dye, is to apply about 6 drops of dye and solvent upon one component, a dry dye form may be printed or otherwise impregnated upon the indicator component. A liquid vehicle phase (which is solvent to at least the indicator dye) then can be added, to ensure distribution of the dye and activator over both media. An absorbent medium for the indicator can also define any shape or indicia message, such as "OPENED" in FIG. 3A, if the liquid activator material is not also a solvent to the printed form of indicia.

While preferred embodiments of the invention have been shown and described, the invention is to be defined by the scope of the appended claims.

I claim:

1. In a container closure integrity system comprising a container having an aperture initially covered by an impermeable seal and a cap adapted removably to be placed over said aperture, so that an inner cap surface is superposed in relation to said seal, the improvement comprising a two component indicator dye/activator combination and a cap with a transparent portion, wherein a first component of the indicator dye/activator combination is mounted proximate said interior cap surface and is at least partially visible through said transparent cap portion, and the second component of the indicator dye/activator combination is mounted proximate the outer surface of said impermeable seal, with means sealingly to enclose the two components in a liquid phase between the cap inner surface and seal outer surface wherein, further, the indicator dye component comprises a first absorbent medium having an indicator dye portion which exhibits a color that is a function of the pH of an associated activator solution, and said activator component comprises a second absorbent medium permeated by a volatile alkali solution, having a pH in the range of 9–12.

2. The improvement of claim 1, wherein said indicator dye has a color response to variations in the range 9–12 and is selected from the group consisting of Methyl Red, Bromthymol Blue, Para-Nitrophenol, Dinitrophenol, Phenolphthalein, Meta Nitrophenol, Chlorphanol Red, Benzo Red, Meta-cresol Purple, Benzo Yellow and Brom Cresol Green, and is solubilized in a volatile solvent prior to being permeated into said first absorbent medium, wherein further, said volatile alkali solution is selected from the group consisting of aqueous solutions of sodium hydroxide, potassium hydroxide, ammonia and organic amines, having a pH in the range of 9–12.

3. The improvement of claim 2, wherein said first and second absorbent materials are of single-weave woven cotton, said indicator dye component is phenolphthalein, said volatile solvent is isopropyl alcohol, and said volatile alkali solution comprises aqueous ammonia, whereby said indicator dye/activator combination initially produces a red color visible through said transparent cap window portion, and said color irreversibly fades with respect to both absorbent mediums upon the opening of said cap and exposure to air, as a result of shrinkage of said medium together with loss of said alkali, and oxidation of said phenolphthalein, whereby the pH of the indicator/activator combination is reduced.

4. The improvement of claim 1, wherein said seal comprises a metallic foil bonded over said aperture and said means sealingly to enclose the two components further comprises a set of threads between the cap inner surface and an outer surface of said container, proximate the aperture, said threads being adapted to clamp the edges of said first and second absorbent mediums between the cap and said aperture.

5. The improvement of claim 1, wherein said second component comprises a single-weave cotton absorbent medium which initially is wetted with a solution of ammonia water, said transparent cap portion centrally is disposed within the top of a circular cap, and said first component comprises an absorbent medium with a selectively applied zone of phenolphthalein that is visible through said transparent cap portion, and exhibits an indicia of a first color, when placed in contact with said second component to define said liquid phase, and said indicia changes to a second color, when said liquid phase is exposed to the atmosphere.

6. A container closure integrity indicator having a first component comprised of a sheet of absorbent material permeated with an indicator dye in solution with a volatile solvent, and a second component comprised of a sheet of absorbent material permeated with a volatile activator solution, having a pH outside of the range of 5–7, wherein the two components initially are sealed together, between a closed container surface and a superposed transparent cap member, and the resulting liquid phase defined by the components is characterized by a color, which is a function of any change to the liquid phase pH with respect to the relative amounts of dye, volatile solvent solution, and volatile activator solution.

7. The indicator of claim 6 wherein said indicator dye is in solution with isopropyl alcohol, has a color response to pH variations in the range of 9–12 and is selected from the group consisting of Methyl Red, Bromthymol Blue, Para-Nitrophenol, Dinitrophenol, Phenolphthalein, Meta Nitrophenol, Chlorphanel Red, Benzo Red, Meta-cresol Purple, Benzo Yellow and Brom Cresol Green, wherein, further, said volatile activator solution is selected from the group consisting of aqueous solutions of Sodium Hydroxide, Potassium Hydroxide, Ammonia, and organic amines having a pH in the range of 9–12.

8. The indicator of claim 7, wherein said closed container surface comprises a metallic foil and said cap member comprises a sheet of transparent material superposed, in a surrounding relation, to said foil.

9. The indicator of claim 7, wherein said second component comprises a single-weave cotton absorbent medium which initially is wetted with a solution of ammonia water, said transparent cap portion centrally is disposed within the top of a circular cap, and said first component comprises an absorbent mdium with a selectively applied zone of phenolphthalein that is visible through said transparent cap portion, and exhibits an indicia of a first color, when placed in contact with said second component to define said liquid phase, and said indicia changes to a second color, when said liquid phase is exposed to the atmosphere.

10. The indicator of claim 6, wherein said closed container surface comprises a metallic foil and said cap member comprises a sheet of transparent material superposed, in a surrounding relation, to said foil.

11. The indicator of claim 6, wherein said second component comprises a single-weave cotton absorbent medium which initially is wetted with a solution of ammonia water, said transparent cap portion centrally is disposed within the top of a circular cap, and said first component comprises an absorbent medium with a selectively applied zone of phenolphthalein that is visible through said transparent cap portion, and exhibits an indicia of a first color, when placed in contact with said second component to define said liquid phase, and said indicia changes to a second color, when said liquid phase is exposed to the atmosphere.

12. A process for detecting loss of integrity of a closure system for a container which comprises a liquid impermeable container surface and a superposed transparent cap member, comprising the steps of:

(a) applying a first component of absorbent material with an indicator dye that is soluble with a volatile solvent;

(b) wetting a second component of absorbent material with a volatile activator solution having a pH in the range of 9–12;

(c) sealing the two components between said container surface and its superposed cap member to define a liquid phase which is characterized by a color which will be a function of the liquid phase pH, the relative amounts of dye, volatile solvent solution and volatile activator solution.

13. The process of claim 12, wherein said indicator dye is selected from the group consisting of Methyl Red, Bromthymol Blue, Para-Nitrophenol, Dinitrophenol, Phenolphthalein, Meta Nitrophenol, Chlorphanel Red, Benzo Red, Meta-cresol Purple, Benzo Yellow and Brom Cresol Green, wherein further, said volatile activator solution is selected from the group consisting of aqueous solutions of Sodium Hydroxide, Potassium Hydroxide, Ammonia, and organic amines having a pH in the range of 9–12.

14. The process of claim 13, wherein said step of applying the first absorbent material comprises using said volatile solvent selectively to wet a layer of dye as an indicia upon a surface of the medium that will be visible through said transparent member.

15. The process of claim 13, wherein said first and second absorbent materials are single weave absorbent cotton, said dye is phenolphthalein, said volatile solvent is isopropyl alcohol, said volatile activator solution is aqueous ammonia and said sealing step further comprises the engagement of a set of threads on an inner surface of said cap member and an outer surface of said container so as to clamp the peripheries of said first and second absorbent materials between cap and a portion of said container surface which defines a sealed aperture surface of said container.

* * * * *